US005582042A

United States Patent [19]

Mordick

[11] Patent Number: 5,582,042

[45] Date of Patent: Dec. 10, 1996

[54] SAFETY DOUBLE LOCK

[75] Inventor: Brian L. Mordick, Shoreview, Minn.

[73] Assignee: Federal-Hoffman, Inc., Anoka, Minn.

[21] Appl. No.: 398,563

[22] Filed: Mar. 3, 1995

[51] Int. Cl.[6] ..... E05B 73/00

[52] U.S. Cl. ..... 70/14; 70/19; 70/57; 70/DIG. 63

[58] Field of Search ..... 70/14, 18, 19, 70/57, 58, 200, 203, DIG. 63; 292/307 R, 307 A, 307 B

[56] References Cited

U.S. PATENT DOCUMENTS

| | | | |
|---|---|---|---|
| 2,560,624 | 7/1951 | Bartlett | 70/14 |
| 2,963,895 | 12/1960 | Thomas | 70/14 |
| 3,677,259 | 6/1972 | Reque et al. | 70/14 |
| 3,889,497 | 6/1975 | Tuttle | 70/14 |
| 4,085,599 | 4/1978 | Fischer et al. | 70/14 |
| 4,409,804 | 10/1983 | Sork | 70/14 |
| 4,864,834 | 9/1989 | Waite | 70/14 |
| 5,020,342 | 6/1991 | Doan et al. | 70/14 |
| 5,167,135 | 12/1992 | Gobeski | 70/14 |
| 5,365,757 | 11/1994 | Primeau | 70/14 |

FOREIGN PATENT DOCUMENTS

| | | | |
|---|---|---|---|
| 346278 | 12/1921 | Germany | 70/14 |
| 175600 | 3/1935 | Switzerland | 70/14 |

OTHER PUBLICATIONS

"Safety Lockouts," Hoffman Engineering Company advertising brochure, p. 507, 1995.

Sketch of lock holder dated May 27, 1993.

*Primary Examiner*—Suzanne L. Dino

*Attorney, Agent, or Firm*—Merchant, Gould, Smith, Edell, Welter & Schmidt, P.A.

[57] ABSTRACT

A double lock apparatus (10) includes interconnected locking members (12) connected by a retainer pin (14). The members include arcing slots (22) and a pair of orifices (24) and (26). Each of the locking members includes an arcing slot arcing in an opposite direction and centered on the opposite of the orifices (24) and (26). The external lock members (42) and (44) insert through the orifices (24) and (26) to prevent pivoting. Removal of one of the external lock members (42) or (44) allows pivoting about the other lock member with the retainer pin sliding along one of the arcing slots (22). The pivoting motion separates retainer finger portions (20) to allow unlatching. The devices (10) may be connected in a series for providing unlocking by removal of one of a number of external locks.

10 Claims, 4 Drawing Sheets

SAFETY DOUBLE LOCK

BACKGROUND OF THE INVENTION

1. Field of the Invention

The present invention is directed to a safety double lock and in particular to a locking apparatus in which removal of one of two or more attached locks allows for releasing of the double lock apparatus.

2. Description of the Prior Art

Devices which provide for locking a latch to a cover or other enclosure are well known. In many applications, it is desired to lock an enclosure to which two or more parties may desire access. In order to provide access for both parties, it is necessary to share keys for the lock of the enclosure. An alternative is to have two or more locks on the latch, thereby requiring both parties to open their lock at the same time in order to gain access. Devices are known which allow for many parties to provide a lock for a latching device, requiring many parties to be present at the same time or to actuate a lock in order to remove or secure the latch.

The problem with the prior art devices is that they require removal of all of the locks rather than one or the other. There are many situations in which it is desired to have access to the enclosure without compromising security by having keys shared or by requiring removal of two or more locks at the same time to gain access. Attempts to provide access to a latch with a device which can be locked by removing one or the other have been complicated and require many parts for manufacture. In addition, such devices have only contemplated the use of two locks rather than providing for a series of locks whereby the device can be actuated by removal of any one of the locks.

It can be seen then that a device is needed which provides for securing a latch by using two or more locks and which provides for releasing the latch by removal of any one of the locks. It can further be appreciated that such a device should provide for easy manufacturing. Such a device should be inexpensive and provide for securing the latch with an unlimited number of locks whereby the latch can be released by removing any one of the locks. The present invention addresses these as well as other problems associated with latches having access provided by releasing one of a plurality of locks.

SUMMARY OF THE INVENTION

The present invention is directed to a double lock apparatus for securing a latch by unlocking one or the other of two or more attached padlock or other lock devices. The double lock device includes two pivotally connected locking members which have interacting fingers which form an enclosure to secure a latch or other lockable device. The locking members are also connected by two additional padlocks or other locks which prevent pivoting relative to one another and therefore unlocking of the double lock apparatus. However, removal of one or the other of the locks allows for pivoting of the locking device and therefore unlocking of the double lock apparatus.

The locking members are connected by a pivot pin inserting into arcing slots which overlap, but arc in opposite directions on the two locking members. In addition, the members have orifices at a lower portion of the lock members which align when the double lock apparatus is closed and which are centered on one or the other of the arcing slots. When locked, the locking members are retained so that the locks prevent pivoting relative to one another. However, removal of one or the other of the locks allows the pivot pin to slide along the arcing slot of one of the members and allow pivoting of the two members relative to one another. Removal of the other of the attached lock devices allows the pivot retainer pin to slide along the other of the arcing slots and allow pivoting about the other external lock. Pivoting in either direction separates the overlapping finger portions to allow removal of the double lock apparatus.

It can be appreciated that the interlocking fingers may be placed through aligned orifices in an adjacent double lock apparatus so that the devices may be connected in a series. This provides for connecting an additional locking member and for unlocking the first lock device by unlocking any one of the external locks attached in the series.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

BRIEF DESCRIPTION OF THE DRAWINGS

In the drawings, wherein like reference letters and numerals designate corresponding elements throughout the several views.

DETAILED DESCRIPTION OF THE PREFERRED EMBODIMENT(S)

Figure 1:
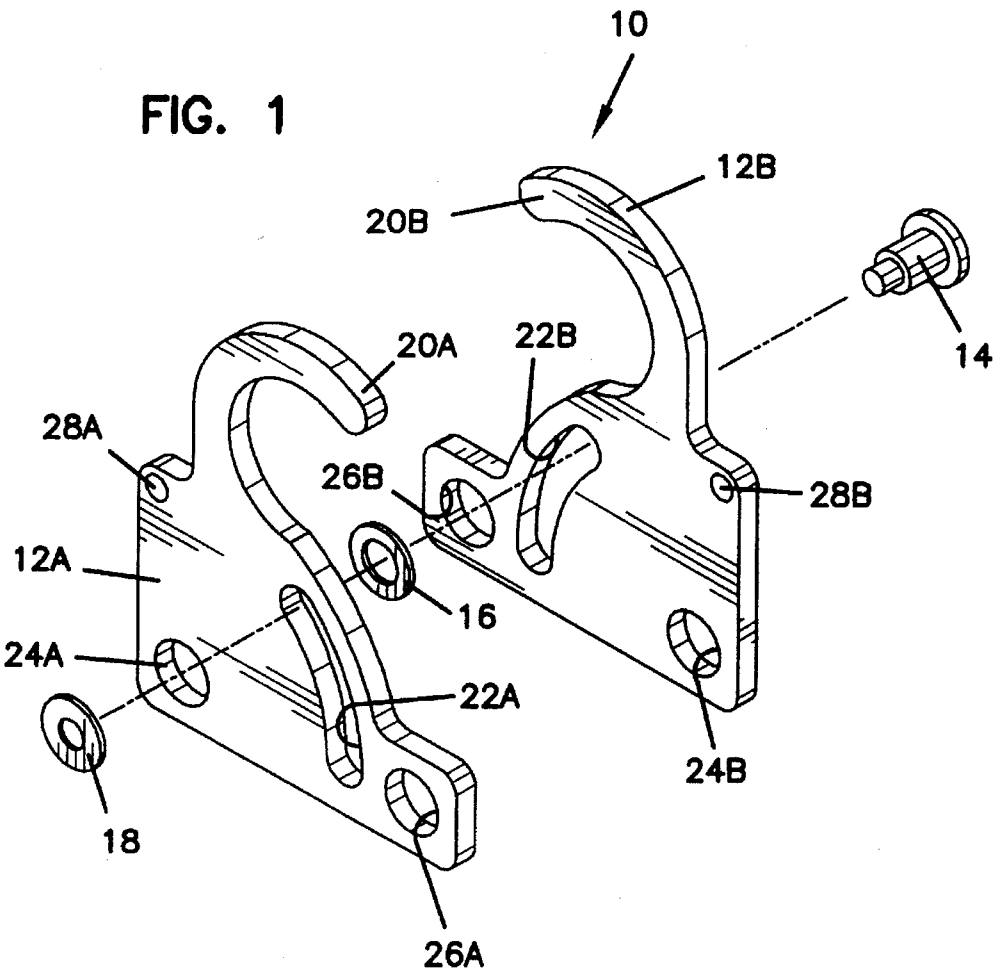
FIG. 1 shows a perspective exploded view of a double lock apparatus according to the principles of the present invention.

Referring now to the drawings, wherein like reference numerals designate corresponding structure throughout the views, and referring in particular to FIG. 1, there is shown a double lock apparatus, generally designated 10. The double lock apparatus 10 is generally used in applications where padlocks or other similar lock devices are generally used. The double lock apparatus 10 includes a pair of lock members 12, pivotally connected with a retainer pin 14 with a cap 18. A washer 16 may insert between the lock members 12 on the retaining pin 14. A chain (not shown) may also be attached to hold the locking device when not in use. The chain attaches to a chain attachment orifice 28.

Figure 2:
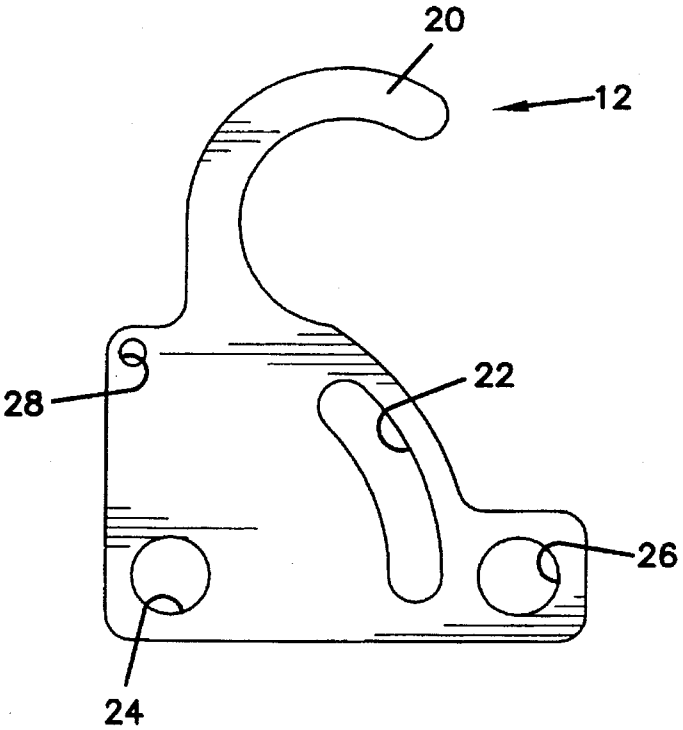
FIG. 2 shows a front elevational view of a lock member for the double lock apparatus shown in FIG. 1.

As shown in FIG. 2, each of the lock members 12 includes a finger portion 20 and an arcing slot 22. The arcing slot 22 is substantially centered and arcs about a center point having a first orifice 24 aligned therewith. A second orifice 26 is equidistant spaced to the lower portion of the lock member 12. The orifices 24 and 26 receive securing members inserting therethrough. The securing members may typically be padlocks or other lock type members to prevent unlocking of the double lock device.

Figure 3:
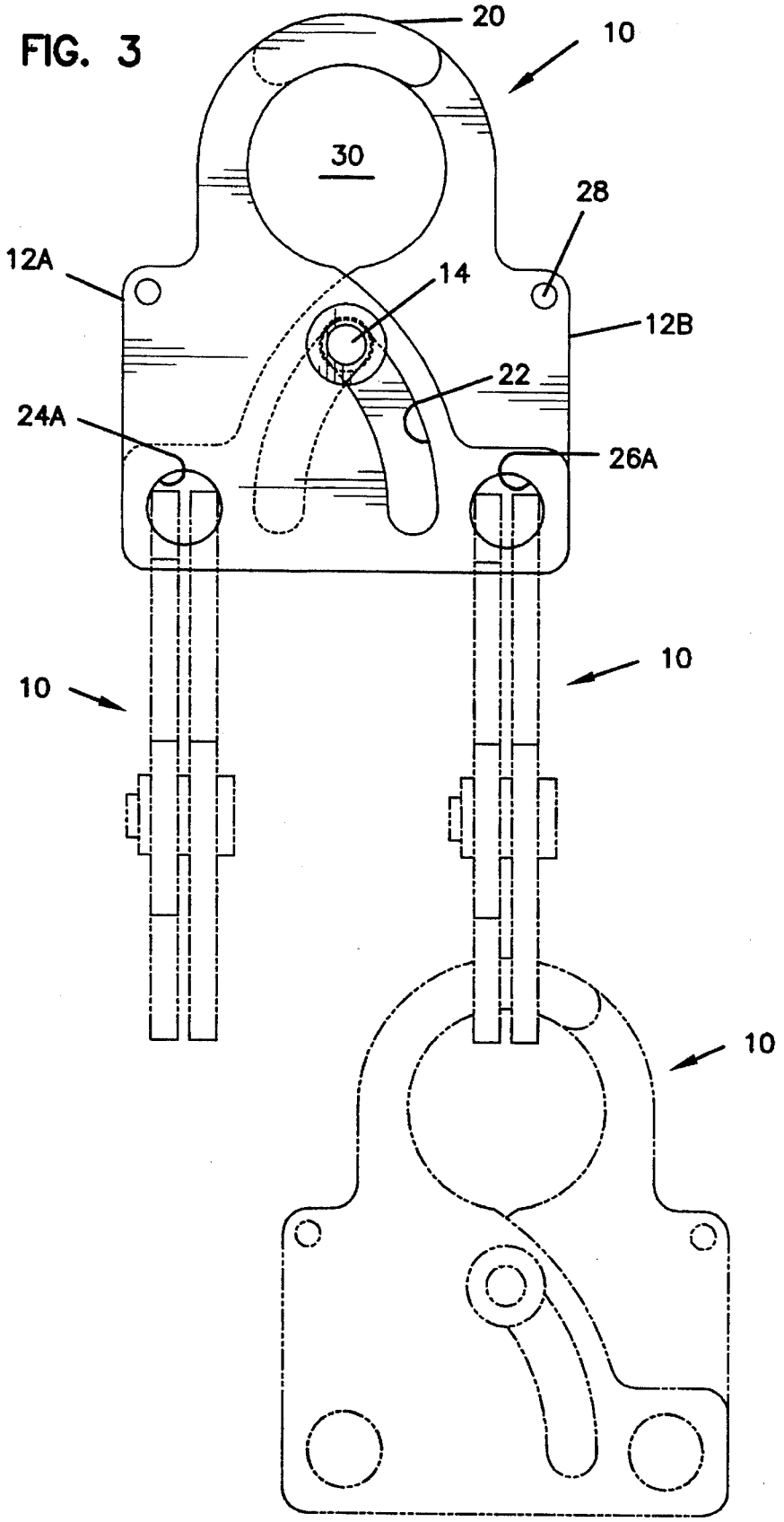
FIG. 3 shows a front elevational view of the double lock apparatus shown in FIG. 1 in a locked position with additional lock apparatuses attached in series.

Referring now to the interaction of each of the lock members, hereinafter designated 12*a* and 12*b*. It can be appreciated that the lock members 12*a* and 12*b* are identical in a preferred embodiment and are assembled in reverse configuration with the retaining pin 14 holding the lock members 12*a* and 12*b* together in a slidably retained arrangement. Hereinafter, elements of the first lock member 12*a* will are designated with "a" and elements of lock member 12*b* are designated with "b" for clarity. In the locked position, as shown in FIG. 3, the finger portions 20*a* and 20*b* overlap to form an orifice 30. The orifice 30 will receive a U-bolt or other portion of the latch which is being locked by the device 10. When closed, the first orifices 24*a* and 24*b* overlap with the second orifices 26*b* and 26*a*, respectively, as shown in FIG. 1. The first orifice 24*a* of the first locking member 12*a* is aligned with the second orifice 26*b* of the second lock member 12*b*. In addition, the first orifice 24*b* of the second lock member 12*b* is aligned with the second orifice 26*a* of the first lock member 12*a*. In the closed position, the arcing slots 22*a* and 22*b* overlap at their upper end to receive the retaining pin 14.

Figure 4:
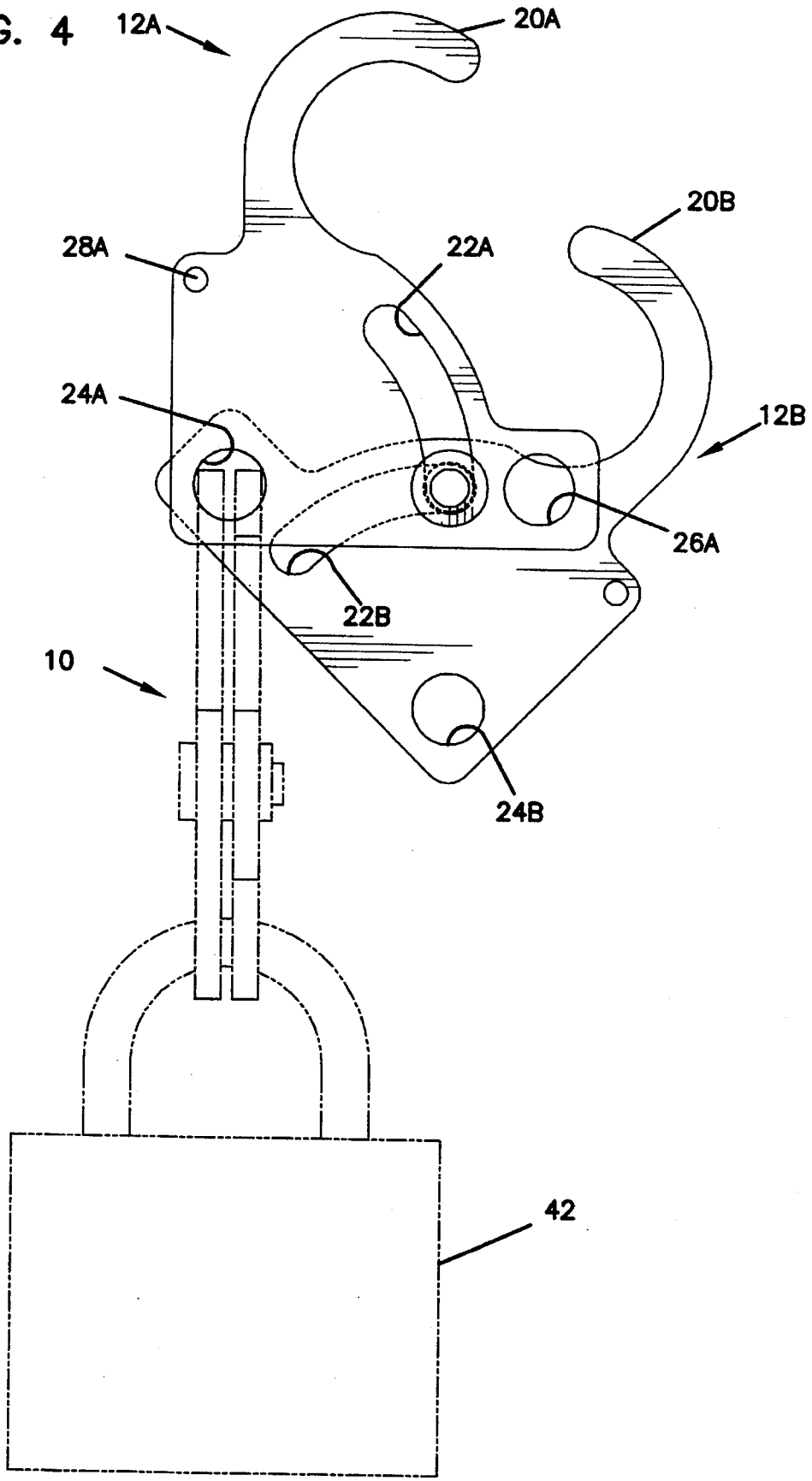
FIG. 4 shows a front elevational view of the double lock apparatus shown in FIG. 1 in an unlocked position, with a first attached lock removed; and, FIG. 5 shows a front elevational view of the double lock apparatus shown in FIG. 1 in an unlocked position, with a second additional lock removed.
Figure 5:
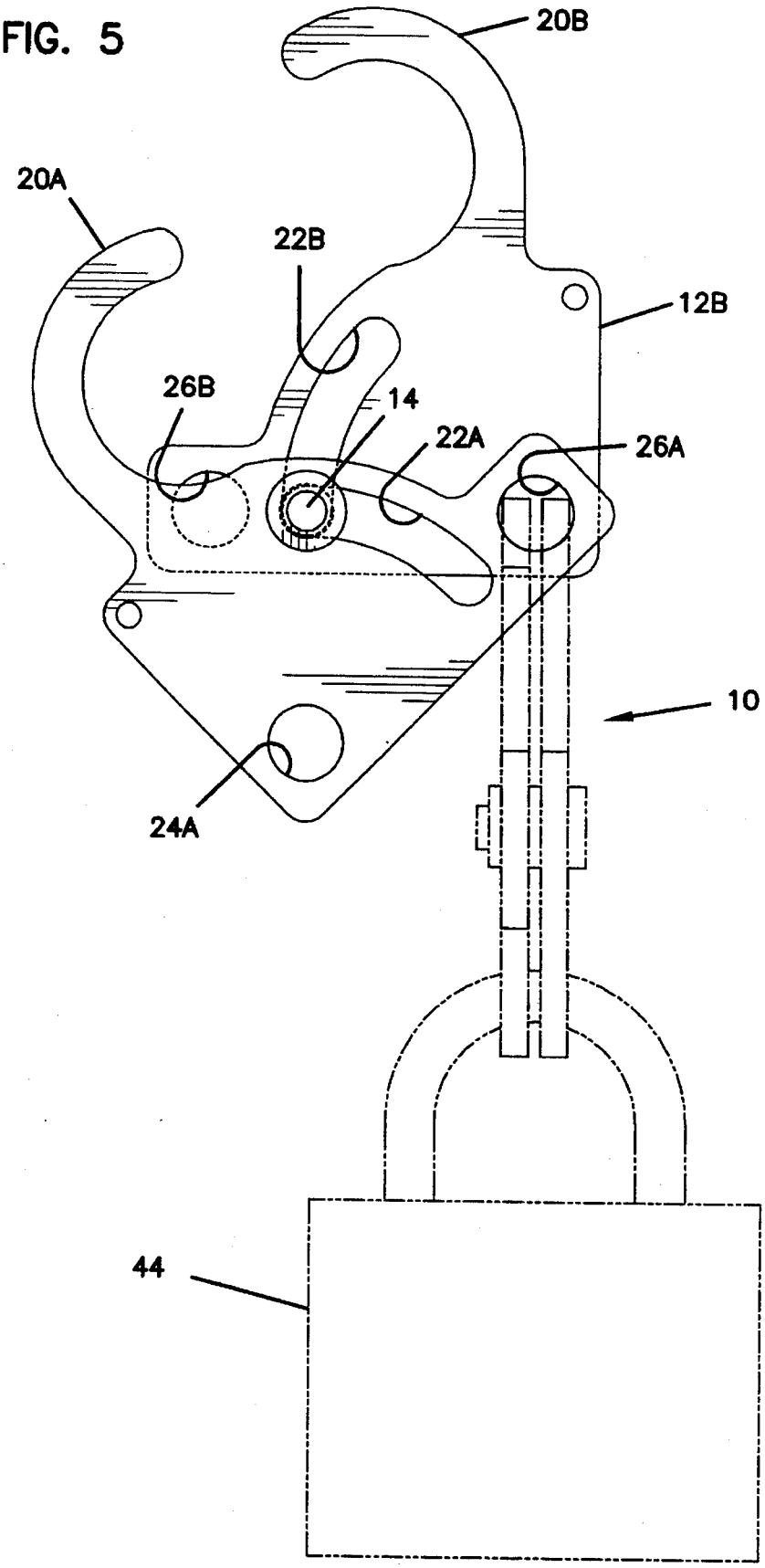

Referring to FIG. 3, the uppermost double lock apparatus is shown in a locked position. The orifices 24 and 26 of the lock members 12*a* and 12*b* are aligned. As shown, overlapped finger portions of added double lock apparatuses 10 are inserted through the aligned orifices 24 and 26 of the lock members 12*a* and 12*b*. This prevents pivoting of the lock members 12*a* and 12*b*. It can be appreciated that although additional double lock apparatuses 10 are shown, padlocks or other devices may insert through the orifices 24 and 26 to prevent unlocking, as shown in FIGS. 4 and 5. It can also be appreciated that either one or both of the additional double lock apparatuses 10 could be replaced with another type of lock without affecting the utility of the uppermost double lock device 10. Although as shown in FIG. 3, the double lock apparatuses 10 are shown with four apparatuses 10 arranged in a series, a single apparatus 10 may be utilized with two padlocks or other attached lock devices. It can also be appreciated that greater numbers of double lock apparatuses 10 may be utilized. The number of apparatuses used will affect the number of attached locks which are used, with each added double lock apparatus 10 requiring an additional attached lock. However, even with multiple double lock apparatuses 10, removal of any one attached lock device will provide for unlocking and opening the uppermost double lock apparatus 10.

Referring now to FIGS. 4 and 5, to unlock the double lock apparatus 10, one of the retainer attached lock devices must be removed. In FIG. 4, the right lock device is removed. This allows the retainer pin 14 to slide along arcing slot 22*a* centered about first orifice 24*a* and second orifice 26*b*. The retainer pin 14 stays in the same upper position in the second arcing slot 22*b*. This provides for pivotally sliding the lock members 12*a* and 12*b* relative to one another. The relative pivoting of the members 12*a* and 12*b* moves the finger portions 20*a* and 20*b* apart, thereby opening the double lock apparatus 10 and allowing it to be removed.

In a similar manner, by removing the left attached lock member from the orifices 24*b* and 26*a*, as shown in FIG. 5, the retainer pin 14 can slide along arcing slot 22*b*. The retainer pin 14 remains in the same upper position in arcing slot 22*a*. This pivoting motion occurs about the right attached locking device and provides for opening the double lock apparatus 10.

It can be appreciated that in either of the unlocked configurations shown in FIGS. 4 or 5, the finger portions 20*a* and 20*b* spread apart allowing the latched device to be unlocked. This unlocking passes up through a series of double lock apparatuses 10, so that removal of a lower adjacent double lock apparatus 10 unlocks the next upper double lock apparatus 10. This characteristic provides for unlocking a series of double lock apparatuses 10 by removal of a single attached lock device.

It can be seen that the present invention provides a simple apparatus and method for locking a latch with a device which may accept two or more padlocks. The locking device utilizes identical lock members 12 which overlap, decreasing manufacturing and assembling costs. The lock members 12 provide for a rugged durable easy to manufacture construction. Moreover, the lock devices 10 may be chained together in series to provide for unlatching of the enclosure by unlocking one of the great number of locks.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A lock device, comprising:

a first member including a hook portion, and having a first arcing slot formed therethrough and first and second orifices formed therethrough;

a second member including a hook portion, a second arcing slot formed therethrough and first and second orifices formed therethrough;

a retaining member extending through the first and second slots in the first and second members and coupling the first and second members in sliding engagement, sliding between a locked position wherein the hook portions overlap and an unlocked position wherein the hook portions disengage;

first means removably inserting into the first orifice in the first member and the second orifice in the second member for preventing the retaining member from sliding along the first slot;

second means removably inserting in the second orifice in the first member and the first orifice in the second member for preventing the retaining member from sliding along the second slot; and, wherein in the locked position, the first slot's arc is centered about the first orifice of the first member and the second orifice of the second member, and the second slot's arc is centered about the first orifice of the second member and the second orifice of the first member so that upon unlocking the lock device and removal of either the first or second means, the retaining member is retained in a stationary position in one of the slots.

2. A lock device according to claim 1, wherein the hook portions overlap to form an aperture.

3. A lock device according to claim 1, wherein the first and second member are identical.

4. A lock device according to claim 3, wherein the first and second members overlap in a mirror image arrangement.

5. A locking device according to claim 4, wherein the first and second members pivot about the first slide preventing means and the second slide preventing means.

6. A locking device according to claim 1, wherein the slots are located intermediate the first and second orifices.

7. A locking device according to claim 1, wherein the first and second orifices are selectively configured to receive overlapped hook portions of another lock device.

8. A lock device, comprising:

a first member including a hook portion, and having a first arcing slot formed therethrough and first and second orifices formed therethrough;

a second member including a hook portion, a second arcing slot formed therethrough and first and second orifices formed therethrough;

a retaining member extending through the first and second slots in the first and second members and coupling the first and second members in sliding engagement, sliding between a locked position wherein the hook portions overlap and an unlocked position wherein the hook portions disengage; and, wherein in the locked position, the first slot's arc is centered about the first orifice of the first member and the second orifice of the second member, and the second slot's arc is centered about the first orifice of the second member and the second orifice of the first member.

9. A lock device according to claim 8, wherein the first and second slots arc in opposite directions.

10. A lock device according to claim 8, wherein the slots are intermediate the hook portions and both of the first and second orifices.

* * * * *